US006203959B1

(12) United States Patent
Tanikawa et al.

(10) Patent No.: US 6,203,959 B1
(45) Date of Patent: Mar. 20, 2001

(54) TONER

(75) Inventors: Hirohide Tanikawa; Masami Fujimoto, both of Shizuoka-ken; Takakuni Kobori, Susono; Hiroyuki Fujikawa, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/521,378

(22) Filed: Mar. 8, 2000

(30) Foreign Application Priority Data

Mar. 9, 1999 (JP) ..... 11-060944

(51) Int. Cl.[7] ..... G03G 9/08
(52) U.S. Cl. ..... 430/110; 430/109; 430/137
(58) Field of Search ..... 430/110, 109, 430/137

(56) References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,921,771 | 5/1990 | Tomono et al. | 430/110 |
| 5,225,303 | 7/1993 | Tomita et al. | 430/106.6 |
| 5,292,609 | 3/1994 | Yoshikawa et al. | 430/110 |
| 5,364,722 | 11/1994 | Tanikawa et al. | 430/110 |
| 5,384,224 | 1/1995 | Tanikawa et al. | 430/106 |
| 5,605,778 | 2/1997 | Onuma et al. | 430/110 |
| 5,629,122 | 5/1997 | Tanikawa et al. | 430/110 |
| 6,120,961 * | 9/2000 | Tanikawa et al. | 430/110 |

FOREIGN PATENT DOCUMENTS

| | | |
|---|---|---|
| 0 743 563 | 11/1996 | (EP) . |
| 0834775 | 4/1998 | (EP) . |
| 58-215659 | 12/1983 | (JP) . |
| 62-100775 | 5/1987 | (JP) . |
| 4-124676 | 4/1992 | (JP) . |
| 4-299357 | 10/1992 | (JP) . |
| 4-358159 | 12/1992 | (JP) . |
| 4-362953 | 12/1992 | (JP) . |
| 6-130714 | 5/1994 | (JP) . |
| 6-332244 | 12/1994 | (JP) . |
| 8-278662 | 10/1996 | (JP) . |
| 8-334919 | 12/1996 | (JP) . |
| 8-334920 | 12/1996 | (JP) . |
| 52-3305 | 1/1997 | (JP) . |
| 10-104875 | 4/1998 | (JP) . |
| 10-161347 | 6/1998 | (JP) . |

* cited by examiner

*Primary Examiner*—John Goodrow
(74) *Attorney, Agent, or Firm*—Fitzpatrick, Cella, Harper & Scinto

(57) ABSTRACT

An electrophotographic toner is formed of a resinous composition including a binder resin and a wax (A). The wax (A) contains at least 92 wt. % thereof of n (normal)-paraffin comprising a plurality of n-paraffin species having different numbers of carbon atoms, and provides a DSC (differential scanning calorimetry)-heat-absorption curve exhibiting a maximum heat-absorption peak showing a peaktop temperature of 70–90° C. and a half-value width of at most 12° C. As a result of the n-paraffin-rich characteristic and the DSC-thermal characteristic, the wax can exhibit an improved fixability-improving effect without showing an excessive plasticizing effect, whereby the toner can exhibit good fixability as well as good flowability and storage stability.

16 Claims, 2 Drawing Sheets

TONER

FIELD OF THE INVENTION AND RELATED ART

The present invention relates to a toner for use in electrophotography, electrostatic recording and toner jetting.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is transferred via or without via an intermediate transfer member onto a transfer(-receiving) material or fixation sheet, such as paper etc., as desired, fixed by heating, pressing, or heating and pressing, or with solvent vapor, to obtain a copy or print carrying a fixed toner image. A portion of the toner remaining on the photosensitive member without being transferred is cleaned by various means, and the above mentioned steps are repeated for a subsequent cycle of image formation.

Various methods and devices have been developed for the step of fixing a toner image onto a sheet of paper, etc. For example, there are a pressure and heat fixing method using hot rollers, and a heat fixing method wherein a sheet carrying a toner image is pressed by a pressing member against a heating member via a film.

In such a hot roller fixing scheme and a heat fixing scheme using a film, a toner image surface carried on a fixation sheet is caused to pass in contact with the surface of a hot roller or film surfaced with a material exhibiting releasability with respect to the toner, thereby fixing the toner image onto the fixation sheet. In these methods, the hot roller or film surface contacts the toner image on the fixation sheet, it is possible to attain a very good heat efficiency for melt-attaching the toner image onto the fixation sheet, thus allowing quick fixation which is very advantageous in electrophotographic copying machines and printers. However, in the above-described methods wherein the hot roller or film surface contacts the toner image in a molten state, there can occur an undesirable offset phenomenon that a portion of the toner image is attached onto the fixing roller or film surface and then re-transferred to soil a subsequent fixation sheet. Accordingly, it is important to prevent the toner from being attached to the hot fixing roller or film surface in the heat-fixing scheme.

Hitherto, for the purpose of preventing toner attachment onto the fixing roller surface, it has been practiced to form the roller surface of a material showing good releasability to a toner, such as silicone rubber or fluorine-containing resin, and coating the roller surface with a film of liquid showing good releasability, such as silicone oil, for offset prevention and preventing the roller surface fatigue. This method is very effective for preventing toner offset but is accompanied with a difficulty that a device for supply offset-preventing liquid is required to complicate the fixing device.

This is a measure contrary to a current demand for a smaller-sized and light-weight apparatus. Moreover, the silicone oil can be vaporized on heating to soil the inside of the apparatus. Accordingly, based on a concept of supplying an offset prevention liquid from toner particles, it has been proposed to incorporate a release agent, such as low-molecular weight polyethylene or low-molecular weight polypropylene, within toner particles.

Further, toners containing two or more species of waxes for exhibiting better addition region to a high temperature region have been effects from a low temperature disclosed in Japanese Patent Publication (JP-B) 52-3305, Japanese Laid-Open Patent Application (JP-A) 58-215659, JP-A 62-100775, JP-A 4-124676, JP-A 4-299357, JP-A 4-358159, JP-A 4-362953, JP-A 6-130714 and JP-A 6-332244.

However, such toners have their own problems. For example, a toner exhibiting excellent anti-high-temperature offset characteristic may leave a room for improvement of low-temperature fixability. A toner exhibiting excellent anti-low-temperature offset characteristic and low-temperature fixability may exhibit somewhat inferior anti-blocking property and developing performance or fail to satisfy anti-offset property at both low temperatures and high temperatures.

Excellent toners having solved such problems have been disclosed in JP-A 8-278662, JP-A 8-334919, JP-A 8-334920, JP-A 10-104875 and JP-A 10-161347. These publications have proposed to use low melting point waxes for exhibiting excellent fixability. A low melting point wax can provide an improved fixability because of its plasticizing effect but is liable to adversely affect the flowability and anti-blocking property of the toner, and the use thereof has been restricted to some extent.

On the other hand, electrophotographic copying machines and printers in recent years are used systematically, and higher functionality and higher speed thereof are required. For complying with these demands, a toner is required of not only properties under melting but also powdery characteristics at normal temperature. For complying with a higher speed, a toner is required to exhibit better movement in the developing device and cleaner and improved anti-melt sticking onto the developing sleeve and photosensitive member, so that further improvements are desired.

SUMMARY OF THE INVENTION

A generic object of the present invention is to provide a toner having solved the above-mentioned problems.

A more specific object of the present invention is to provide a toner showing excellent fixability.

Another object of the present invention is to provide a toner exhibiting excellent storage stability and flowability yet free from toner plugging or cleaning failure.

Another object of the present invention is to provide a toner exhibiting excellent storage stability and flowability and allowing stable toner movement in the developing device and stable developing performance.

A further object of the present invention is to provide a toner excellent in anti-melt-sticking property, thus well suppressing the melt-sticking onto the developing sleeve and the photosensitive drum.

According to the present invention, there is provided a toner, comprising a resinous composition including a binder resin and a wax (A), wherein the wax (A) contains at least 92 wt. % thereof of n (normal)-paraffin comprising a plurality of n-paraffin species having different numbers of carbon atoms, and provides a DSC (differential scanning calorimetry)-heat-absorption curve exhibiting a maximum heat-absorption peak showing a peaktop temperature of 70–90° C. and a half-value width of at most 12° C.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
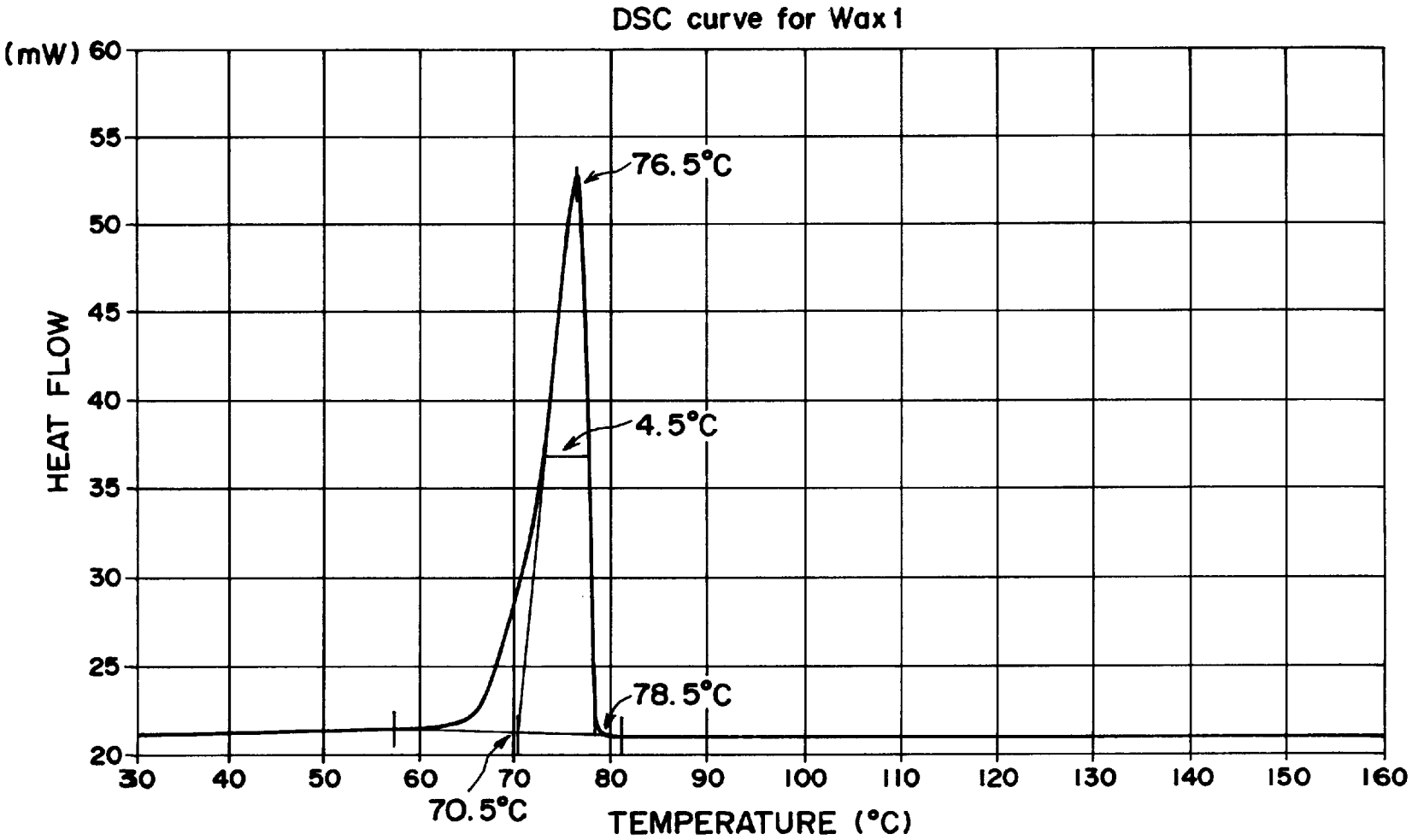
FIG. 1 shows a heat-absorption curve of Wax 1 as measured by DSC (differential scanning calorimetry).

By including a wax component compatible with (i.e., dissolved in or in mixture with) its binder resin, a toner can exhibit various functions and behaviors. During the toner fixation, if the wax component melts to exhibit a low viscosity at an appropriate temperature, the wax component can migrate within the binder resin to exhibit a plasticizing effect or appear at the toner particle surfaces to exhibit a boundary effect. At the time of toner melting, the wax component may exhibit plasticizer effect, release effect and peeling effect, thus providing an improved toner fixability, preventing the toner from being offset onto the fixing member and soiling the fixing member, and obviating difficulties, such as paper winding or jamming at the fixing device.

The toner according to the present invention is characterized by containing a wax (A) which provides a DSC-heat-absorption curve exhibiting a maximum heat-absorption peak showing a peaktop temperature of 70–90° C., more preferably 75–90° C., further preferably 75–85° C. The wax (A) exhibits a low melt-viscosity and tends to be present at toner particle surfaces so as to exhibit a phase separation function with respect to the binder resin component, so that it shows a large plasticizing effect on the toner particle surfaces and affects the toner storability, toner flowability, anti-toner melt-sticking property, continuous developing performance and cleaning stability. Below 70° C., the anti-blocking property and storability of the toner are lowered, and above 90° C., a remarkable improvement of fixability cannot be expected.

The presence of i(iso)-paraffinic hydrocarbons having branching structures naphthenic hydrocarbons having ia cycloparaffin structure or aromatic hydrocarbons, exerts a large plasticizing effect, so that the wax (A) used in the present invention is caused to contain at least 92 wt. % of linear n(normal)-paraffinic structured hydrocarbons, thereby providing an improved fixability without adversely affecting the storability, flowability, anti-melt-sticking property, continuous developing performance and cleaning stability. The n-paraffin content is preferably at least 93 wt. %, more preferably at least 94 wt. %, particularly preferably at least 95 wt. %, so as to provide further improved fixability without adverse effects. Below 92 wt. %, any of the flowability, storability, anti-melt-sticking property and continuous developing performance can be adversely affected as a restriction to the use of the wax (A), thus failing to fully enjoy the benefit of fixability-improving effect.

The wax (A) used in the present invention is further characterized by a half-value width of at most 12° C. of the maximum heat-absorption peak on its DSC-heat-absorption curve, so as to provide the storability and fixability of the toner. The half-value width is preferably at most 10° C., further preferably at most 8° C. The wax (A) having such a narrow half-value width can effectively exhibit the plasticizing effect, thus providing an excellent fixability-improving effect at a small addition amount. Further, as adverse effects accompanying the addition of an increased amount of wax, such as lowering in developing performance, lowering in anti-blocking property and lower flowability leading to cleaning trouble and melt-sticking onto the drum, are suppressed, a further improvement in fixability can be expected by increasing the addition amount thereof. If the half-value width exceeds 12° C., either the storability or the fixability is adversely affected, so that it becomes difficult to obtain a toner having satisfactory storability and fixability in combination.

Further, it is preferred that the DSC-heat-absorption curve exhibits an initial onset temperature of at least 50° C. and a terminal onset temperature of at most 100° C., so as to enhance the above-mentioned effects. If the initial onset temperature is below 50° C., the storability is liable to be inferior, and if the terminal onset temperature exceeds 100° C., the fixability-improving effect is reduced.

In order to more effectively attain the above-mentioned effects, the initial onset temperature is more preferably at least 55° C., particularly preferably at least 60° C., and the terminal onset temperature is more preferably at most 95° C., particularly preferably at most 90° C.

The plasticizing effect attained by the wax (A) not only is effective for lowering the toner melt-viscosity and increasing the toner fixability but also is particularly noticeably exhibited at proximity to the toner particle surfaces, so that the toner melt-viscosity at proximity to the surface is effectively lowered to exert an effective anchoring effect to the recording medium and thus remarkably contribute to an improvement in fixability. On the other hand, an excessive plasticizing effect does not occur, so that it is possible to obtain a toner excellent in anti-blocking property and storability and exhibiting easy processability.

A conventional toner excellent in low-temperature fixability has caused toner melt-sticking due to a partial melting thereof in some cases when the toner is rubbed by a cleaning blade in the cleaner or by a doctor blade on the developing sleeve. Even in such cases, the toner according to the present invention can suppress the occurrence of melt-sticking as the plasticizing effect of the wax (A) is moderated to some extent.

Further, the toner of the present invention shows a good flowability, thus exhibiting a smooth movement in the cleaner, and is free from toner clogging in the cleaner leading to the breakage of the cleaner or cleaning failure due to a local stagnation of the toner, while exhibiting excellent fixability. Further, the toner movement in the developing device and the toner hopper is stabilized, so that the toner replenishment and toner blending before and after the replenishment are well performed, thus stabilizing the developing performance. As the stability of movement in the cleaner and the developing device is increased, the toner can exhibit improved continuous image forming performances in combination with the improved fixability in high-speed image forming apparatus.

The wax (A) used in the present invention may preferably comprise, e.g., polyolefins obtained by purifying low-molecular weight by-products during polymerization for producing high-molecular weight polyolefins; polyolefins polymerized in the presence of catalysts, such as a Ziegler catalyst or a metallocene catalyst; paraffin wax, Fischer-Tropsche wax; synthetic hydrocarbon waxes obtained from starting materials such as coal and natural gas through processes, such as the Synthol process, the Hydrocol process and the Arge process; synthetic waxes obtained from monocarbon compound as a monomer; hydrocarbon waxes having functional groups, such as hydroxyl group and carboxyl group; and mixtures of a hydrocarbon wax and a hydrocarbon wax having a functional group.

These waxes may preferably be treated by the press sweating method, the solvent method, re-crystallization, vacuum distillation, supercritical gas extraction or melt-crystallization so as to provide a narrower molecular weight distribution or remove impurities, such as low-molecular weight solid aliphatic acids, low-molecular weight solid alcohols, or low-molecular weight solid compounds.

Further preferred examples may include: paraffin waxes, Fischer-Tropshe wax, polyethylene produced by metallocene catalyst, and distillation purification products from low-molecular weight by-products obtained during ethylene polymerization; and particularly preferred are paraffin waxes and Fischer-Tropsche wax in view of dispersibility, resulting in remarkable fixability improving effect and excellent developing performance of the resultant toner.

It is preferred that the n-paraffins have an average number of carbon atoms of 30–55, further preferably 32–50, particularly preferably 34–45, so as to provide a good balance between the fixability, and storability and flowability of the resultant toner. Below 30, the storability and flowability are liable to be inferior, and above 55, the fixability-improving effect is liable to be lowered.

The wax (A) having a high n-paraffin content may be obtained through purification and fractionation at a high accuracy by utilizing the press sweating method, the solvent method, re-crystallization, vacuum distillation, supercritical gas extraction, melt-crystallization, etc. It is particularly preferred to effect purification based on the solvent method using a solvent or a solvent mixture showing a relatively low dissolving power to wax. Examples of such a relatively poor solvent (mixture) may include: mixtures of benzene or toluene and ketone (such as acetone or methyl ethyl ketone); methyl isobutyl ketone; liquefied propane; trichloroethylene/benzene mixture; and dichloroethane/dichloromethane mixture.

More specifically, the purification may for example be performed in the following manner. A solvent (mixture) is added to a starting wax under heating to completely dissolve the wax, and the solution is then cooled to crystallize the wax. The cooling is performed down to a prescribed temperature corresponding to an objective DSC maximum heat-absorption peaktop temperature of the product wax, and the wax is filtered out. The temperature control is accurately performed while using a slow cooling speed to separate the non-normal paraffin components inclusive of iso-paraffins, naphthenes and aromatics and increase the n-paraffin content. The resultant wax cake is further washed with a solvent (mixture) to reduce the non-n-paraffin components. The above step are repeated to increase the n-paraffin content. Finally, the solvent is separated from the wax by a solvent recovery apparatus. The wax product may further be subjected to hydrorefining, activated day treatment and deodoring treatment, as desired. It is also preferred to use a starting wax of which the molecular weight distribution has been narrowed in advance by vacuum distillation, gas extraction or molten liquid crystallization in order to increase the n-paraffin content of the product wax.

Hitherto, a low-melting point wax as represented by a DSC maximum heat-absorption peaktop temperature of below 65° C. may be provided with an increased n-paraffin content by a conventional solvent method, but it has been difficult to obtain a wax having a high-melting point of 70° C. or higher, particularly 75° C. or higher, and yet having an increased n-paraffin content. Also, the conventional (vacuum) distillation method can provide a wax having a narrower-molecular weight distribution, but it has been difficult to sufficiently reduce the iso-paraffin and naphthene contents.

Examples of starting waxes suitably applicable to the above-described solvent process may include: slack wax and paraffin wax obtained from petroleum wax, polymerization by-products obtained in ethylene polymerization, low-molecular weight polyethylene polymerized by using a metallocene catalyst, and Fischer-Tropsche wax obtained from coal or natural gas as the starting material.

The wax (A) used in the present invention may preferably exhibit a kinematic viscosity of at most 20 $mm^2/s$, more preferably 1–10 $mm^2/s$, as measured at 100° C. according to JIS K2283-3.8 so as to exhibit a preferable plasticizing effect, and also a penetration of at most 10, more preferably at most 8, as measured at 25° C. according to JIS K2235-5.4, so as to prevent an excessive plasticizing effect.

In the toner of the present invention, the wax (A) may preferably be contained in 0.2–20 wt. parts, more preferably 0.5–10 wt. parts, per 100 wt. parts of the binder resin, so as to exhibit its effect.

The DSC-heat-absorption curves referred to herein are those obtained by using an internal heating input compensation-type differential scanning calorimeter ("DSC-7", available from Perkin-Elmer Corp.) according to ASTM D3418-82. Before taking a DSC curve, a sample is once heated and cooled for removing its thermal history, and then subjected to heating at a rate of 10° C./min. for taking the DSC curve (an example thereof being given as FIG. 1 for Wax 1). The respective temperatures are defined as follows:

[Peaktop Temperature of a Maximum Heat-absorption Peak (Tmax.abs)]

Peaktop temperature of a peak having the largest height from a base line on a DSC curve (e.g., 76.5° C. for Wax 1).

[Half-value width of the maximum heat-absorption peak]

A temperature width of the maximum heat-absorption peak at a height that is a half of the peaktop height, respectively from the base line (e.g., 4.5° C. for Wax 1).

[Initial Onset Temperature]

A temperature at an intersection of a tangential line taken at a point on the DSC-heat-absorption curve giving a maximum of differential with the base line (e.g., 70.5° C. for Wax 1).

[Terminal Onset Temperature]

A temperature at an intersection of a tangential line taken at a point on the DSC-heat-absorption curve giving a minimum of differential with the base line (e.g., 78.5° C. for Wax 1).

The n-paraffin contents referred to herein are based on values measured by quantitative analysis using a gas chromatograph ("GC-17A", available from Shimazu Seisakusho K. K.) with a column carrying a liquid phase of dimethylsiloxane, a film thickness of 0.25 $\mu$m, an inner diameter×length of 0.25 mm×15 m, and a flame ionization detector (FID).

For the measurement, helium is used as the carrier gas. The column is held in a thermostat vessel, of which the temperature is initially held at 60° C., heated at a rate of 40° C./min. to 160° C., heated at a rate of 40° C./min. to 160° C., then at a rate of 15° C./min. to 350° C. and then at rate of 7° C./min. to 445° C., and the temperature is held for 4 min. The gasification chamber is initially at 70° C. and heated at a rate of 250° C./min. to 445° C., followed by holding for 0.1 min. The detector is held at 445° C. A sample is dissolved in heptane at a concentration of 0.1 wt. %.

n-Paraffins having 20, 24, 28, 30, 32, 36, 40 and 44 carbon atoms are used as standard substances, and retention times for n-paraffins having other numbers of carbon atoms are determined by interpolation and extrapolation. For measured peaks of a sample wax, another peak between peaks for n-paraffins having adjacent numbers of carbon atoms is regarded as a peak for non-normal component (e.g., an i-paraffin). The n-paraffin content of a sample wax is given by a percentage of total area of peaks for n-paraffin components with respect to total area of all the peaks for all the components in the sample wax.

The average number Cav. of carbon atoms is calculated according to the following equation based on a weight (i.e., areal)-basis distribution of n-paraffins having different numbers of carbon atoms:

$$Cav. = (1/n) \cdot \sum_{Ci=1}^{n} Ci \cdot Fi,$$

wherein Ci denotes a number of carbon atoms of a n-paraffin component ranging from 1 to n, n is taken at 100, and Fi is a weight (i.e., areal) content in percentage of a n-paraffin having Ci carbon atoms.

Further, it is preferred that the wax (A) shows a standard deviation S in carbon number distribution of n-paraffins according to the following formula of 0.5–10, more preferably 1.0–8.0, further preferably 1.5–6.0, so as to exhibit a well-balanced plasticizing effect:

$$S = \left[ \sum_{Ci=1}^{n} (Ci - Cav)^2 \cdot Fi / (n-1) \right]^{0.5}$$

n-Paraffin wax of S<0.5, particularly a single-component pure n-paraffin, shows an excessively high crystallinity, and fine dispersion thereof in the toner becomes difficult. On the other hand, n-paraffin wax of S>10.0 is liable to exhibit an excessively large plasticizing effect are adversely affect the anti-blocking property.

In the present invention, the wax (A) may preferably exhibit a distribution of carbon numbers of which the content or frequency continuously or smoothly changes with an increase in number of carbon atoms, i.e., without showing an intermittent or alternate increase (or decrease) of content at every other or intermittent number of carbon atoms among a continuously increasing number of carbon atoms, so as to realize both a hardness at normal temperature and a low melt-viscosity on melting, thus satisfying excellent storability and powder characteristics and excellent fixability in combination.

The toner according to the present invention, i.e., the resin composition therefor, can further contain another wax (B) for supplementing the release effect. Such another wax (B) may preferably be one giving a maximum heat-absorption peak showing a peaktop temperature in a range of 90–150° C. Examples of the wax (B) may include: montane wax and derivatives thereof, microcrystalline wax and derivatives thereof, Fischer-Tropsche wax and derivatives thereof, polyolefin wax and derivatives thereof, and carnauba wax and derivatives thereof. The derivatives may include an oxide, a block copolymer with a vinyl monomer and a graft-modification product. Other examples may include: alcohol waxes, aliphatic acid waxes, acid amide waxes, ester waxes, ketone waxes, hardened castor oil and derivatives thereof, vegetable waxes, animal waxes, mineral waxes, and petrolactum.

A preferred class of the wax (B) may include: low-molecular weight polyolefins and by-products obtained during radical polymerization under a high pressure or polymerization in the presence of a Ziegler catalyst or a metallocene catalyst of olefins, low-molecular weight polyolefins obtained by thermal decomposition of high-molecular weight polyolefins, distillation residues of hydrocarbons obtained from a synthesis gas comprising carbon monoxide and hydrogen by using a catalyst, and waxes obtained from synthetic hydrocarbons obtained by hydrogenating such distillation residues. These waxes can contain an anti-oxidant added thereto. Further examples may include: linear alcohol waxes, aliphatic acid waxes, acid amide waxes, ester waxes and montan derivatives. It is also preferred to use such a wax after removing impurities such as fatty acids.

It is also preferred to use a wax (B) obtained by fractionation of the above waxes depending on molecular weights by the press sweating, the solvent method, vacuum distillation, supercritical gas extraction, fractional crystallization (e.g., melt-crystallization and crystal filtration), etc.

The wax (B) may preferably be used in such an amount as to provide a total amount with the wax (A) of 0.5–20 wt. parts, more preferably 1.0–15 wt. parts, per 100 wt. parts of the binder resin.

The binder resin for the toner of the present invention may for example comprise: polystyrene; homopolymers of styrene derivatives, such as poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, chmarone-indene resin and petroleum resin. Preferred classes of the binder resin may include styrene copolymers and polyester resins.

Examples of the comonomer constituting such a styrene copolymer together with styrene monomer may include other vinyl monomers inclusive of: monocarboxylic acids having a double bond and derivative thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

It is possible that the binder resin inclusive of styrene polymers or copolymers has been crosslinked or can assume a mixture of crosslinked and un-crosslinked polymers.

The crosslinking agent may principally be a compound having two or more double bonds susceptible of polymerization, examples of which may include: aromatic divinyl compounds, such as divinylbenzene, and divinyl-naphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture.

The binder resin as represented by styrene-copolymers may be produced through bulk polymerization, solution polymerization, suspension polymerization or emulsion polymerization.

In the bulk polymerization, it is possible to obtain a low-molecular weight polymer by performing the polymerization at a high temperature so as to accelerate the termination reaction, but there is a difficulty that the reaction control is difficult. In the solution polymerization, it is possible to obtain a low-molecular weight polymer or copolymer under moderate conditions by utilizing a radical chain transfer function depending on a solvent used or by selecting the polymerization initiator or the reaction temperature. Accordingly, the solution polymerization is preferred for preparation of a low-molecular weight styrene (co-)polymer exhibiting a peak in a molecular weight region of $5\times10^3$–$10^5$ on a GPC chromatogram.

The solvent used in the solution polymerization may for example include xylene, toluene, cumene, cellosolve acetate, isopropyl alcohol, and benzene. It is preferred to use xylene, toluene or cumene for a styrene monomer mixture. The solvent may be appropriately selected depending on the polymer produced by the polymerization. The reaction temperature may depend on the solvent and initiator used and the polymer or copolymer to be produced but may suitably be in the range of 70–230° C. In the solution polymerization, it is preferred to use 30–400 wt. parts of a monomer (mixture) per 100 wt. parts of the solvent. It is also preferred to mix one or more other polymers in the solution after completion of the polymerization.

In order to produce a high-molecular weight styrene (co-)polymer giving a peak in a molecular weight region of $10^5$ or higher or a crosslinked styrene (co-)polymer, the emulsion polymerization or suspension polymerization may preferably be adopted.

Of these, in the emulsion polymerization method, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium while the amount is affected by the amount of the monomer relative to the aqueous medium. The polymerization temperature may suitably be in the range of 50–95° C. and selected depending on the polymerization initiator used and the objective polymer. The polymerization initiator should be insoluble or hardly soluble in water.

Examples of the initiator may include: t-butylperoxy-2-ethylhexanoate, cumyl perpivalate, t-butyl peroxylaurate, benzoyl peroxide, lauroyl peroxide, octanoyl peroxide, di-t-butyl peroxide, t-butylcumul peroxide, dicumul peroxide, 2,2'-azobisisobutylonitrile, 2,2'-azobis(2-methylbutyronitrile, 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy) cyclohexane, 1,4-bis(t-butylperoxycarbonyl)cyclohexane, 2,2-bis(t-butylperoxy)octane, n-butyl-4,4-bis(t-butylperoxy) valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy) hexane, di-t-butyldiperoxyisophthalate, 2,2-bis(4,4-di-t-butylperoxycyclohexyl)propane, di-t-butylperoxy-α-methylsuccinate, di-t-butylperoxydimethylglutarate, di-t-butylperoxyhexahydroterephthalate, di-t-butylperoxyazelate, 2,5-dimethyl-2,5-di-(t-butylperoxy) hexane, diethylene glycol-bis(t-butylperoxycarbonate), di-t-butylperoxytrimethyl-azipate, tris(t-butylperoxy)triazine, and vinyl-tris(t-butylperoxy)silane. These initiators may be used singly or in combination in an amount of at least 0.05 wt. part, preferably 0.1–15 wt. parts, per 100 wt. parts of the monomer.

The polyester resin used in the present invention may be constituted as follows.

Examples of the dihydric alcohol may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

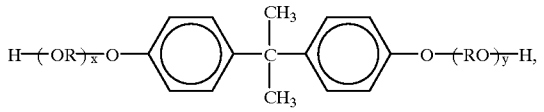

wherein R denotes an ethylene or propylene group, x and y are independently 0 or a positive integer with the proviso that the average of x+y is in the range of 0–10; and diols represented by the following formula (B):

(B)

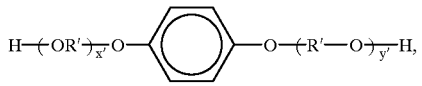

wherein R' denotes

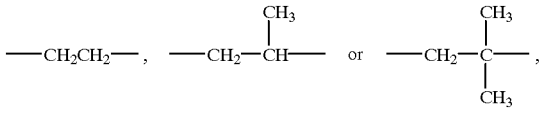

x' and y' are independently 0 or a positive integer with the proviso that the average of x'+y' is in the range of 0–10.

Examples of the dibasic acid may include dicarboxylic acids and derivatives thereof including: benzenedicarboxylic acids, such as phthalic acid, terephthalic acid and isophthalic acid, and their anhydrides or lower alkyl esters; alkyldicarboxylic acids, such as succinic acid, adipic acid, sebacic acid and azelaic acid, and their anhydrides and lower alkyl esters; alkenyl- or alkylsuccinic acid, such as n-dodecenylsuccinic acid and n-dodecyl acid, and their anhydrides and lower alkyl esters; and unsaturated dicarboxylic acids, such as fumaric acid, maleic acid, citraconic acid and itaconic acid, and their anhydrides and lower alkyl esters.

It is preferred to also use polyhydric alcohols having three or more functional groups and polybasic acids having three or more acid groups.

Examples of such polyhydric alcohol having three or more hydroxyl groups may include: sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of polybasic carboxylic acids having three or more functional groups may include polycarboxylic acids and derivatives thereof including: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, Empol trimer acid, and their anhydrides and lower alkyl esters; and tetracaboxylic acids represented by the formula:

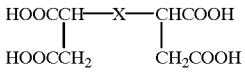

(X denotes a $C_5$ to $C_{30}$-alkylene group or alkenylene group having at least one side chain having at least three carbon atoms), and their anhydrides and lower alkyl esters.

The polyester resin used in the present invention may preferably be constituted from 40–60 mol. %, more preferably 45–55 mol. %, of the alcohol component and 60–40 mol. %, more preferably 55–45 mol. %, of the acid component respectively based on the total of the alcohol and acid components. Further, the total of the polyhydric alcohol and the polybasic acid each having three or more functional groups may preferably constitutes 5–60 mol. % of the total alcohol and acid components constituting the polyester resin.

The polyester resin may be produced from the above-mentioned alcohol component and acid component according to a polycondensation process which per se is well known.

In addition to the above-mentioned binder resin components, the toner according to the present invention can further contain another resinous component in a minor amount (i.e., an amount less than that of the above-mentioned binder resin components). Examples of such another resinous component may include: silicone resin, polyurethane, polyamide, epoxy resin, polyvinyl butyral, rosin, modified rosin, terpene resin, phenolic resin, and copolymers of two or more species of α-olefins.

The binder resin used in the present invention may preferably exhibit a glass transition point (Tg) of 45–80° C., more preferably 50–70° C.

The binder resin constituting the toner of the present invention may preferably comprise a low-molecular weight resin showing a weight-average molecular weight (Mw) based on GPC (gel permeation chromatography) of $4\times10^3$–$5\times10^4$, preferably $5\times10^3$–$3\times10^4$, and a high-molecular weight resin showing Mw of at least $10^5$, preferably at least $1.5\times10^5$, or a crosslinked or non-crosslinked resin forming a gel content (i.e., THF (tetrahydrofuran)-insoluble content, in combination. The low-molecular weight resin and the high-molecular weight or gel content-forming resin may be wet-blended in solvent or dry-blended during a toner production process. It is also possible to use a composite resin comprising a low-molecular weight resin in which a gel content-forming resin is dispersed. It is also possible to use a composite resin formed by synthesizing a high molecular weight or gel content-forming resin in the presence of a low-molecular weight resin, or by synthesizing a low-molecular weight resin in the presence of a high molecular weight or gel content-forming resin.

The molecular weight distribution by GPC (gel permeation chromatography) of a toner or a binder resin may be measured by using THF (tetrahydrofuran) in the following manner.

A GPC sample is prepared as follows.

A resinous sample is placed in THF and left standing for several hours (e.g., 5–6 hours). Then, the mixture is sufficiently shaked until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.45–0.5 μm (e.g., "Maishoridisk H-25-5", available from Toso K. K.; and "Ekikurodisk 25CR", available from German Science Japan K. K.) to recover the filtrate as a GPC sample. The sample concentration is adjusted to provide a resin concentration within the range of 0.5–5 mg/ml.

In the GPC apparatus, a column is stabilized in a heat chamber at 40° C., tetrahydrofuran (THF) solvent is caused to flow through the column at that temperature at a rate of 1 ml/min., and about 100 μl of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K. K. or Showa Denko K. K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex GPC KF-801, 802, 803, 804, 805, 806, 807 and 800P; or a combination of TSK gel G1000H ($H_{XL}$), G2000H ($H_{XL}$), G3000H ($H_{XL}$) G4000H ($H_{XL}$) G5000H ($H_{XL}$), G6000H ($H_{XL}$), G7000H ($H_{XL}$) and TSK guardcolumn available from Toso K. K.

The toner according to the present invention may preferably further contain a positive or negative charge control agent.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; diorganotin borates, such as dibutyltin borate, dioctyltin borate and dicyclohexyltin borate; quanidine compounds, and imidazole compounds. These may be used singly or in mixture of two or more species. Among these, it is preferred to use a triphenylmethane compound or a quaternary ammonium salt having a non-halogen counter ion. It is also possible to use as a positive charge control agent a homopolymer of or a copolymer with another polymerizable monomer, such as styrene, an acrylate or a methacrylate, as described above of a monomer represented by the following formula (1):

(1)

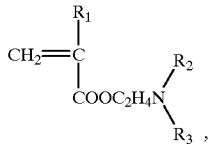

wherein $R_1$ denotes H or $CH_3$; $R_2$ and $R_3$ denotes a substituted or unsubstituted alkyl group (preferably $C_1$–$C_4$). In this instance, the homopolymer or copolymer may be function as (all or a portion of) the binder resin.

It is also preferred to use a compound of the following formula (2) as a positive charge control agent:

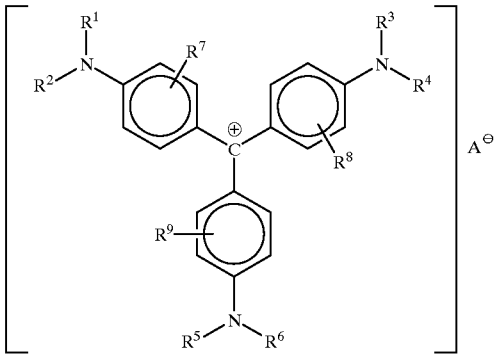

wherein $R^1$, $R^2$, $R^3$, $R^4$, $R^5$ and $R^6$ independently denote a hydrogen atom, a substituted or unsubstituted alkyl group, or a substituted or unsubstituted aryl group; $R^7$, $R^8$ and $R^9$ independently denote a hydrogen atom, a halogen atom, an alkyl group, or an alkoxy group; $A^{\ominus}$ denotes an anion selected from sulfate, nitrate, borate, phosphate, hydroxyl, organo-sulfate, organo-sulfonate, organo-phosphate, carboxylate, organo-borate and tetrafluoroborate ions.

Examples of the negative charge control agent may include: organic metal complexes, chelate compounds, monoazo metal complexes, acetylacetone metal complexes, organometal complexes of aromatic hydroxycarboxylic acids and aromatic dicarboxylic acids, metal salts of aromatic hydroxycarboxylic acids, metal salts of aromatic polycarboxylic acids, and anhydrides and esters of such acids, and phenol derivatives.

It is also preferred to use as a negative charge control agent an azo metal complex represented by the following formula (3):

(3)

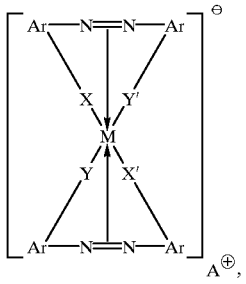

wherein M denotes a coordination center metal, such as Sc, Ti, V, Cr, Co, Ni, Mn or Fe; Ar denotes an aryl group, such as phenyl or naphthyl, capable of having a substituent, examples of which may include: nitro, halogen, carboxyl, anilide, or alkyl or alkoxy having 1–18 carbon atoms; X, X', Y and Y' independently denote —O—, —CO—, —NH—, or —NR— (wherein R denotes an alkyl having 1–4 carbon atoms; and $A^{\oplus}$ denotes a cation, such as hydrogen, sodium, potassium, ammonium or aliphatic ammonium. The cation $A^{\oplus}$ can be omitted.

It is particularly preferred that the center metal is Fe or Cr; the possible substituent of the acryl group Ar is preferably halogen, alkyl or anilide group. It is also preferred to use a mixture of complex salts having different counter ions.

It is also preferred to use as a negative charge control agent as a basic organic acid metal complex represented by the following formula (4):

(4)

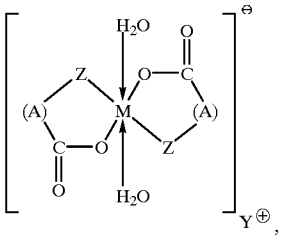

wherein M denotes a coordination center metal, such as Cr, Co, Ni, Mn, Fe, Zn, Al, Si or B; A denotes

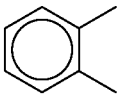

(capable of having a substituent, such as an alkyl, anilide, aryl or halogen)

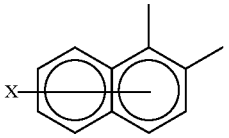

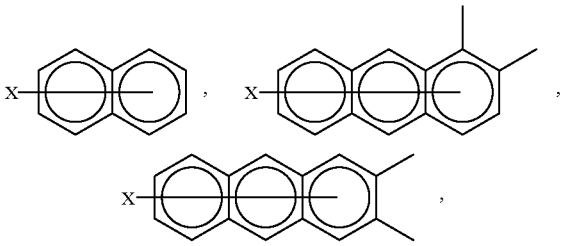

(X denotes hydrogen, halogen, nitro, or alkyl),

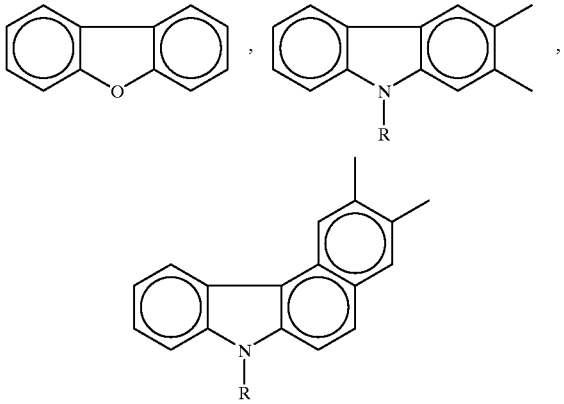

(R denotes hydrogen, $C_1$–$C_{18}$ alkyl or $C_1$–$C_{18}$ alkenyl); $Y^{\oplus}$ denotes a cation, such as hydrogen, sodium, potassium, ammonium, or aliphatic ammonium; and Z denotes —O— or —CO—O—. The cation can be omitted.

It is particularly preferred that the center metal is Fe, Cr, Si, Zn or Al; A in the formula (4) is benzene ring or a naphthalene ring, and substituent thereof is alkyl, anilide or aryl group or halogen; and the cation is hydrogen, ammonium or aliphatic ammonium.

Such a charge control agent may be incorporated in a toner by internal addition into the toner particles or external addition to the toner particles. The charge control agent may be added in a proportion of 0.1–10 wt. parts, preferably 0.1–5 wt. parts, per 100 wt. parts of the binder resin while it can depend on the species of the binder resin, other additives, and the toner production process including the dispersion method.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of at most 2 μm, preferably 0.1–0.5 μm, further preferably 0.1–0.3 μm. The magnetic material may be contained in the toner in a proportion of ca. 20–200 wt. parts, preferably 40–150 wt. parts, per 100 wt. parts of the resin component.

The toner according to the present invention can contain a non-magnetic colorant which may be an appropriate pigment or dye. Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin. Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

It is preferred to use the toner according to the present invention together with fine powder of silica, alumina or titania externally blended therewith in order to improve the charge stability, developing characteristic and fluidity.

The silica, alumina or titania fine powder may provide a good result, if it has a specific surface area of 20 $m^2/g$ or larger, preferably 30–400 $m^2/g$, as measured by nitrogen adsorption according to the BET method. The silica, alumina or titania fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also possible to use two or more treating agents in combination.

In order to provide improved developing performance and durability, it is also preferred to further add powder of another inorganic material, examples of which may include: oxides of metals, such as magnesium, zinc, aluminum, cerium, cobalt, iron, zirconium, chromium, manganese, strontium, tin and antimony; composite metal oxides, such as calcium titanate, magnesium titanate, and strontium titanate; metal salts, such as calcium carbonate, magnesium carbonate, and aluminum carbonate; clay minerals, such as haolin; phosphate compounds, such as apatite; phosphate compounds, such as apatite; silicon compounds, such as silicon carbide and silicon nitride; and carbon powder, such as carbon black and graphite powder. Among these, it is preferred to use zinc oxide, aluminum oxide, cobalt oxide, manganese dioxide, strontium titanate or magnesium titanate.

It is also possible to externally add powder of lubricants, examples of which may include: fluorine-containing resins, such as polytetra-fluoroethylene and polyvinylidene fluoride; fluorinated compounds, such as fluorinated carbon; aliphatic acid metal salts, such as zinc stearate; aliphatic acids and derivatives thereof, such as esters; sulfides, such as molybdenum sulfide; amino acids and amino acid derivatives.

In recent years, it has been desired to provide toner particles having a smaller particle size for the purpose of providing high-definition and high-resolution images. Thus, the toner according to the present invention may preferably have a weight-average particle size (D4) of at most 10 μm, more preferably at most 9 μm, particularly preferably at most 6 μm, so as to provide extremely high-definition images. A weight-average particle size (D4) of at least 3.0 μm is preferred for providing a sufficient image density. A smaller particle size toner is liable to have inferior flowability and storability, but the toner of the present invention is controlled so as not to exhibit an excessive plasticizing effect. As a result, the toner of the present invention can exhibit excellent anti-blocking property and flowability while suppressing troubles in the cleaner during a continuous image formation.

The weight-average particle size (D4) of a toner described herein are based on values measured by using a Coulter Multisizer IIE (available from Coulter Electronics Inc.) together with an electrolytic solution (1%-NaCl aqueous solution: "ISOTON R-II", available from Coulter Scientific Japan K.K.). In the measurement, 0.1–5 ml of a surfactant is added as a dispersant in 100–150 ml of the electrolytic solution, and 2–20 mg of a sample is added thereto. The resultant dispersion of the sample is subjected to a dispersion treatment for 1–3 min. by means of an ultrasonic disperser and then to measurement of volume-basis and number-basis particle size to calculate a weight-average particle size (D4).

For a sample having D4>6.0 μm, a 100 μm-aperture is used for measurement of a distribution of particles in the range of 2–60 μm; for a sample having D4=3.0 to 6.0 μm, a 50 μm-aperture is used for measurement of particles in the range of 1–30 μm; and for a sample having D4<3.0 μm, a 30 μm-aperture is used for measurement of particles in the range of 0.6–18 μm.

The toner according to the present invention can be blended with carrier particles to be used as a two-component type developer. The carrier for use in the two-component developing may comprise known materials, examples of which may include: surface-oxidized or non-oxidized particles of metals, such as iron, nickel, cobalt, manganese, chromium and rare earth metals; alloys and oxides of these metals, each having an average particle size of 20–300 μm.

These carrier particles may preferably be surface-treated by attachment of or coating with a resin such as styrene resin, acrylic resin, silicone resin, fluorine-containing resin, or polyester resin.

The toner according to the present invention may be prepared through a process including: sufficiently blending the binder resin, the wax, optionally a metal compound, a colorant, such as pigment, dye and/or a magnetic material, and an optional charge control agent and other additives, as desired, by means of a blender such as a supermixer, a Henschel mixer, a ball mill or a Nautamixer, melting and kneading the blend by means of hot kneading means, such as hot rollers, a kneader or an extruder to cause melting of the resinous materials and disperse or dissolve the wax, pigment or dye therein, and cooling and solidifying the kneaded product, followed by pulverization by a pulverizer, and as a jet mill, a turbo mill, Krypron or Innomiger, and classification by a classifier, such as Elbow Jet, Turboplex or dispersion separator.

The thus obtained toner may be further blended with other external additives, as desired, sufficiently by means of a mixer such as a supermixer or a Henschel mixer to provide a toner for developing electrostatic images.

In order to produce a toner providing a desired effect of the present invention, it is preferred to finely and uniformly disperse the wax in the binder resin. If the wax dispersion state is ununiform, the wax is dispersed in large particles or isolated wax particles are formed, it is possible that an identical toner composition fails to exhibit sufficient toner performances. In order to provide such a desired dispersion state, it is preferred to place a preliminary step of melt-kneading the wax and the binder resin and then to effect a metal-kneading step for melt-kneading other toner ingredients with the melt-kneaded wax-binder resin mixture. It is also preferred to prepare a binder resin solution in a solvent and mixing the wax with the binder resin solution in a wet state, followed by solvent-removal, drying and pulverization, to prepare a wax-binder resin pre-mix, which is then subjected to melt-kneading with the other toner ingredients. It is also preferred to raise the solution temperature at the time of mixing the wax so that the wax in a molten state is mixed with the binder resin solution.

EXAMPLES

Hereinbelow, the present invention will be described more specifically based on Examples and Comparative Examples.

The following waxes (Waxes 1–15) exhibiting properties shown in Table 1 were used in Examples and Comparative Examples. Wax 1 provided a DSC curve shown in FIG. 1. These waxes were prepared in the following manner.

Waxes 4 and 5 (comparative) were obtained through purification by the conventional solvent method of slack waxes obtained from petroleum wax.

Figure 2:
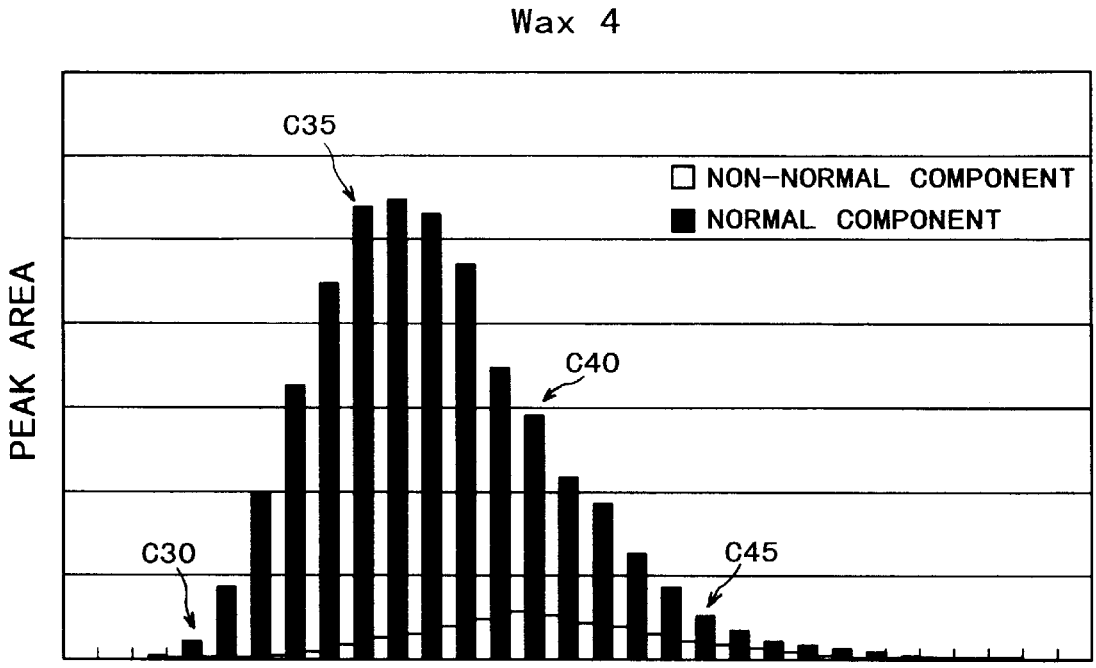
FIGS. 2 and 3 are bar graphs representing respective amounts of normal paraffin components and non-normal paraffin components having different numbers of carbon atoms of Wax 4 and Wax 13 (further purified product of Wax 4), respectively, based on gas chromatography.

More specifically, Wax 4 was prepared as follows. A starting slack wax was dissolved in a toluene/methyl ethyl ketone mixture solvent at 80° C., and then the solution was cooled at a rate of 0.2° C./min. down to 68° C. and held for 1 hour at the temperature, followed by filtration. The recovered wax was washed two times with fresh mixture solvent, and then the solvent was separated by a solvent recovery apparatus, followed by hydrorefining of the recovered wax to obtain Wax 4. FIG. 2 is a bar graph showing relative amounts of n-paraffin components and non-n-paraffin components having different numbers of carbon atoms of Wax 4 based on gas chromatography.

For preparation of Wax 5, the filtrate liquid recovered during the above preparation of Wax 4 (possibly containing wax components soluble at 66° C.) was again heated to 75° C. for wax dissolution, then cooled at a rate of 0.2° C./min. down to 58° C. and then held for 1 hour at that temperature, followed by filtration. The recovered wax was washed two times with fresh mixture solvent, and then the solvent was separated by a solvent recovery apparatus, followed by hydrorefining of the recovered wax to obtain Wax 5.

Waxes 2 and 3 were obtained by effecting a more strict temperature control during the above-mentioned process of purification by the solvent method.

More specifically, Wax 2 was prepared as follows. The same slack wax used as the starting material for production of Wax 4 was dissolved in the same mixture solvent at 80° C., and the solution was cooled at a rate of 0.2° C./min. down to 75° C. and at a rate of 0.1° C./min. down to 68° C., followed by holding for 1 hour at that temperature and filtration. The thus-recovered wax was washed three times with fresh mixture solvent, the solvent was recovered by a solvent recovery apparatus, and then the recovered wax was subjected to hydrorefining to obtain Wax 2.

For preparation of Wax 3, the same slack wax was dissolved in the same mixture solvent at 80° C., and the solution was cooled at a rate of 0.1° C./min. down to 75° C., followed by holding for 1 hour at that temperature and filtration. The thus-obtained filtrate liquid was again heated to 80° C. for dissolution of wax contained therein, and then cooled at a rate of 0.2° C./min. down to 75° C. and then at a rate of 0.1° C./min. down to 66° C., followed by holding for 1 hour at that temperature and filtration. The thus-recovered wax was washed three times with fresh mixture solvent, the solvent was separated by a solvent recovery apparatus, are the recovered wax was hydrorefined to obtain Wax 3.

Figure 3:
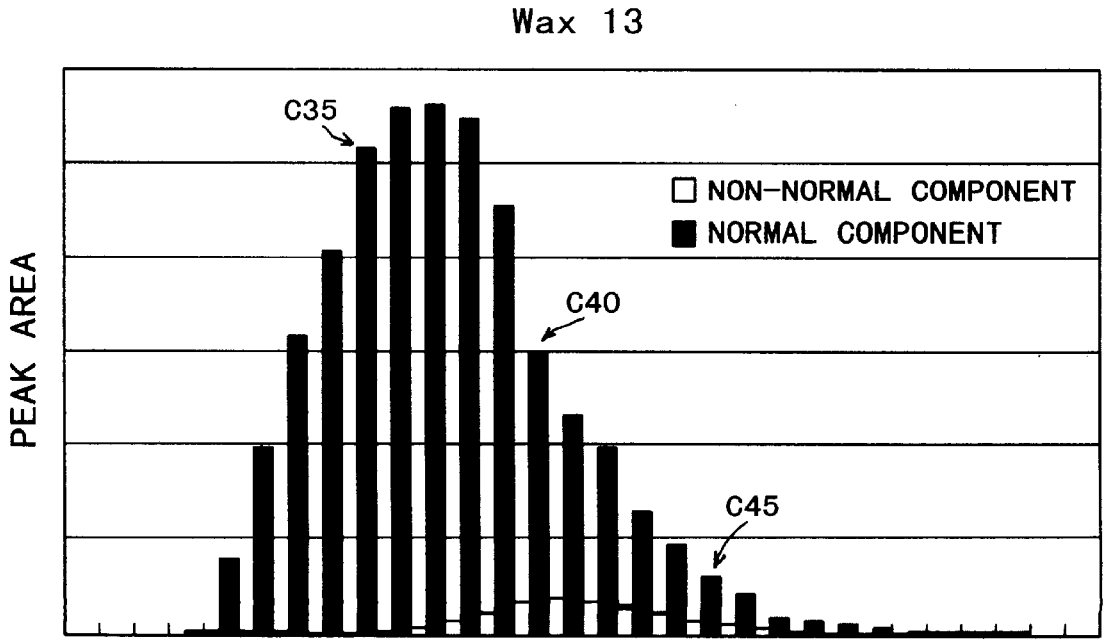

For preparation of Wax 13, Wax 4 was used as the starting wax and dissolve in methyl isobutyl ketone (as the solvent) at 80° C., and the solution was cooled at a rate of 0.2° C./min. down to 75° C. and then at a rate of 0.1° C./min. down to 69° C., followed by holding for 1 hour at that temperature and filtration. The thus-recovered wax was washed three times with fresh solvent, the solvent was separated by solvent recovery apparatus, and the recovered wax was hydrorefined to obtain Wax 13. FIG. 3 is a bar graph showing relative amounts of n-paraffin components and non-n-paraffin components having different numbers of carbon atoms of Wax 13 for comparison with FIG. 2 for Wax 4 used as the starting wax.

For preparation of Waxes 1, 6, 7, 8, 14 and 15, a commercially available Fischer-Tropsche wax prepared from coal or natural gas as the starting material was subjected to vacuum distillation under different conditions to recover 6 wax fractions, which were respectively used as starting materials for purification by the solvent method similarly as in preparation for Wax 13 at different control temperatures and washing times to obtain Waxes 1, 6, 7, 8, 14 and 15.

Wax 9 (comparative) was a Fischer-Tropsche was obtained by vacuum distillation of hydrocarbons formed by the Fischer-Tropsche process using coal as the starting material.

Wax 10 was prepared by subjecting polyethylene obtained by using a metallocene catalyst as the starting wax to purification by the solvent method similarly as in preparation for Wax 13 at different control temperatures and washing times.

Waxes 11 and 12 (comparative) were conventional polyethylene waxes prepared by the Ziegler process.

Binder resins were prepared in the following manner.

<Binder Resin 1>

Copolymer A (styrene/butyl acrylate/divinylbenzene (=80/20/0.01 by weight) copolymer, Tg =67° C., Mw=1.02×$10^6$) was prepared by suspension polymerization using 2,2-bis(4,4-di-t-butyl-peroxycyclohexyl)propane as polymerization initiator. Separately, Copolymer B (styrene/butyl acrylate/monobutyl maleate (=80/15/5 by weight) copolymer, Tg=61° C., Mw=1.5×$10^4$) was prepared by solution polymerization using di-t-butyl peroxide as polymerization initiator. Copolymer A and Copolymer B were blended in a weight ratio of 70:30 in solution to provide Binder resin 1.

<Binder Resin 2>

Copolymer C (styrene/butyl acrylate (=80/20 by weight) copolymer, Tg=67° C., Mw=8.2×$10^5$) was prepared by suspension polymerization using 2,2-bis(4,4-di-t-butyl-peroxycyclohexyl)propane as polymerization initiator. Separately, Copolymer D (styrene/butyl acrylate (=85/15 by weight) copolymer, Tg=61° C., Mw=1.58×$10^4$) was prepared by solution polymerization using di-t-butyl peroxide as polymerization initiator. Copolymer C and Copolymer D were blended in a weight ratio of 70:30 in solution to provide Binder resin 2.

Example 1

| | |
|---|---|
| Binder resin 1 | 100 wt.parts |
| Magnetite (Dav. = 0.2 μm) | 100 " |
| Monoazo iron compound | 2 " |
| Wax 1 | 6 " |

The above ingredients were preliminarily blended by a Henschel mixer and melt-kneaded through a twin-screw extruder set at 110° C. The melt-kneaded product was cooled, coarsely crushed by a cutter mill and then finely pulverized by a pulverizer using a jet air stream, followed by classification by a multi-division classifier utilizing the Coanda effect, to recover negatively chargeable magnetic toner particles having a weight-average particle size (D4) of

TABLE 1

| | | Wax properties | | | | | | | | | |
|---|---|---|---|---|---|---|---|---|---|---|---|
| | | n-parrafin | Carbon member | | Maximum heat-absorption peak | | | | Content | | |
| | Starting | content | distribution | | peaktop | half-value | onset temp.(° C.) | | distribu- | η*3 | Penetra- |
| Wax | wax-type*1 | (wt. %) | Cav. | S | temp.(° C.) | width(° C.) | initial | terminal | tion*2 | (mm²/sec) | tion |
| 1 | F.T. | 97.5 | 37.7 | 4.1 | 76.5 | 4.5 | 70.5 | 78.5 | C | 7 | 6 |
| 2 | Para. | 93.8 | 37.1 | 4.5 | 75.2 | 6.7 | 66.5 | 78.9 | C | 6 | 6 |
| 3 | Para. | 92.6 | 36.1 | 4.8 | 73.8 | 7.1 | 64.2 | 77.8 | C | 5 | 7 |
| 4 | Para. | 90.6 | 37.2 | 3.5 | 75.7 | 4.5 | 66.2 | 79.1 | C | 7 | 6 |
| 5 | Para. | 91.5 | 29.6 | 2.2 | 65.8 | 3.8 | 65.3 | 70.4 | C | 5 | 8 |
| 6 | F.T. | 97.7 | 35.4 | 4.2 | 72.4 | 5.8 | — | 75.1 | C | 6 | 6 |
| 7 | F.T. | 96.8 | 42.3 | 5.5 | 79.6 | 7.7 | 70.4 | 86.4 | C | 7 | 5 |
| 8 | F.T. | 95.7 | — | — | 86.7 | 8.4 | 78.5 | — | C | 14 | 3 |
| 9 | F.T. | 90.1 | 53.5 | 8.1 | 87.4 | 20.2 | 63.6 | 100.7 | C | 16 | 4 |
| 10 | M.PE | 98.1 | 43.5 | 4.6 | 82.3 | 5.0 | 74.2 | — | NC | 12 | 8 |
| 11 | PE | 91.4 | 39.8 | — | 76.5 | 22.1 | 44.0 | 86.5 | NC | 15 | 7 |
| 12 | PE | 90.8 | 57.8 | 8.3 | 93.2 | 15.1 | 72.7 | 102.5 | NC | 23 | 6 |
| 13 | Para. | 94.4 | 38.3 | 3.3 | 76.2 | 6.5 | 67.1 | 79.4 | C | 6 | 6 |
| 14 | F.T. | 97.5 | 37.9 | 4.2 | 78.1 | 6.1 | 72.3 | 81.5 | C | 7 | 6 |
| 15 | F.T. | 95.3 | 42.7 | 5.7 | 81.5 | 7.3 | 75.7 | 88.8 | C | 8 | 5 |

*1F.T. = Fischer-Tropsche wax, Para = paraffin, M.PE = metallocene polyethylene, PE = polyethylene

*2C = continuous, NC = non-continuous

*3η = kinematic viscosity 6.8 μm. To 100 wt. parts of the toner particles, 1.0 wt. part of negatively chargeable hydrophobic silica was externally added and blended therewith by a Henschel mixer to obtain Magnetic toner 1 (D4=6.8 μm).

Magnetic toner 1 was subjected to the following fixing test and continuous image forming test, whereby good fixability and continuous image forming performances were exhibited. The results are inclusively shown in Table 2 appearing hereinafter together with those of Examples are Comparative Examples appearing hereinafter.

[Fixing Test]

A commercially available laser beam printer ("LBP-930EX", available from Canon K.K.) was remodeled by taking out the fixing device and remodeling the fixing device to provide an external fixing device operable outside the printer at arbitrarily set fixing temperatures at a process speed of 100 mm/sec. Sheets of 80 g/m$^2$-paper carrying yet unified toner images formed of a sample toner by using the re-modeled printer were passed through the external fixing device in an environment of 23° C./60% RH to evaluate the fixability. The fixing temperatures were set at varying temperatures in the range of 130–180° C. at intervals of 5° C. The resultant fixed images at the respective temperatures were each rubbed for 5 reciprocations with a lens-cleaning paper under a load of 4.9 kPa so as to evaluate the fixability in terms of a fixing initiation temperature ($T_{F1}$ (° C.)) as a lowest temperature giving an image density lowering due to the rubbing of at most 10%. A lower value of the temperature ($T_{F1}$) represents a better fixability. The image density was measured as a reflection density by using a Macbeth densitometer (available from Macbeth Co.) with an SPI filter.

[Continuous Image Forming Test]

Magnetic toner 1 was subjected to a printing test on 15000 sheets by using a commercially available laser beam printer ("LBP-930EX", available from Canon K.K.) in an environment of 32.5° C./80% RH. As a result, images showing a high image density (I.D.) and with little density (ID) fluctuation were obtained. Detailed results are shown in Table 2. The image density was measured with respect to 5 images of each in 5 mm-square on a sheet formed at the time of image formation on 15000 sheets as an average of 5 values measured as reflection densities by using a Macbeth reflection densitometer (available from Macbeth Co.) together with an SPI filter. The image density fluctuation was evaluated with respect to a solid black image formed after image formation on 15000 sheets and measuring an image density between a highest density part and a lowest density part on the sheet. The evaluation was performed according to the following standard based on the maximum density difference on the same sheet.

| | | |
|---|---|---|
| A: | Density difference | <0.05 |
| B: | " | = 0.05 to below 0.10 |
| C: | " | = 0.10 to below 0.15 |
| D: | " | ≧0.15 |

During the continuous printing test, the resultant images were evaluated with respect to image defects attributable to cleaning failure and melt-sticking on the photosensitive drum due to cleaning trouble liable to be caused by bridging, attachment onto the vessel or parts, caking or melt-sticking of the waste toner. The evaluation was performed according to the following standard.

A: No image abnormality.

B: Cleaning failure and melt-sticking occurred at non-image parts, but the images were not affected.

C: Cleaning failure and melt-sticking occurred at a low frequency but disappeared.

D: Cleaning failure and melt-sticking occurred and failed to disappear in same cases.

After the image formation test, the developing sleeve was inspected and influences thereof on the images were evaluated according to the following standard.

A: No sticking onto the sleeve.

B: Slight sticking observed but did not affect the images.

C: Sticking observed and affected the images to some extent.

D: Image abnormality observed due to melt-sticking onto the sleeve.

[Anti-blocking Test]

20 g of a toner sample was placed in a plastic cup and held in a thermostat vessel at 50° C. for 5 days. Thereafter, the toner state was observed with eyes and evaluated according to the following standard.

A: No agglomerate observed, and the toner flowing smoothly.

B: Some agglomerates observed but instantaneously disintegrated.

C: Agglomerates observed but easily collapsed.

D: Caking observed and did not easily collapse.

Examples 2–10

Magnetic toners 2–10 were prepared and evaluated in the same manner as in Example 1 except for using Waxes 2, 3, 6, 7, 8, 10, 13, 14 and 15, respectively, instead of Wax 1. The results are inclusively shown in Table 2 together with those of Example 1 and Comparative Examples appearing hereinafter.

Comparative Example 1

Magnetic toner 11 (D4=6.5 μm) was prepared and evaluated in the same manner as in Example 1 except for using Wax 4 instead of Wax 1. Magnetic toner 11 exhibited somewhat inferior melt-sticking onto the developing sleeve.

Comparative Example 2

Magnetic toner 12 (D4=6.6 μm) was prepared and evaluated in the same manner as in Example 1 except for using Wax 5 instead of Wax 1. Magnetic toner 12 exhibited inferior continuous image forming performance.

Comparative Example 3

Magnetic toner 13 (D4=6.4 μm) was prepared and evaluated in the same manner as in Example 1 except for using Wax 9 instead of Wax 1. Magnetic toner 13 exhibited inferior sometimes image forming performances.

Comparative Example 4

Magnetic toner 14 (D4=6.7 μm) was prepared and evaluated in the same manner as in Example 1 except for using Wax 11 instead of Wax 1. Magnetic toner 14 exhibited inferior continuous image forming performance and anti-blocking property.

Comparative Example 5

Magnetic toner 15 (D4=6.7 μm) was prepared and evaluated in the same manner as in Example 1 except for using Wax 12 instead of Wax 1. Magnetic toner 15 exhibited inferior fixability.

Example 11

| | |
|---|---|
| Binder resin 2 | 100 wt.parts |
| Magnetite | 90 " |
| Triphenylmethane lake compound | 2 " |
| Wax 1 | 5 " |
| Fischer-Tropshe wax (Tmax.abs. = 98.8° C.) | 2 " |

The above ingredients were preliminarily blended by a Henschel mixer and melt-kneaded through a twin-screw extruder set at 110° C. The melt-kneaded product was cooled, coarsely crushed by a cutter mill and then finely pulverized by a pulverizer using a jet air stream, followed by classification by a multi-division classifier utilizing the Coanda effect, to recover positively chargeable magnetic toner particles having a weight-average particle size (D4) of 6.5 $\mu$m. To 100 wt. parts of the toner particles, 1.0 wt. part of positively chargeable hydrophobic silica was externally added and blended therewith by a Henschel mixer to obtain Magnetic toner 16 (D4=6.5 $\mu$m).

Magnetic toner 16 was subjected to the following fixing test and continuous image forming test, whereby good fixability and continuous image forming performances were exhibited. The results are inclusively shown in Table 3 appearing hereinafter together with those of Examples appearing hereinafter.

[Fixing Test]

A commercially available copying machine ("GP-605", available from Canon K.K.) was remodeled by taking out the fixing device and remodeling the fixing device to provide an external fixing device operable outside the printer at arbitrarily set fixing temperatures at a process speed of 300 mm/sec. Sheets of 80 g/m$^2$-paper carrying yet unified toner images formed of a sample toner by using the re-modeled printer were passed through the external fixing device in an environment of 23° C./60% RH to evaluate the fixability. The fixing temperatures were set at varying temperatures in the range of 140–190° C. at intervals of 5° C. The resultant fixed images at the respective temperatures were each rubbed for 5 reciprocations with a lens-cleaning paper under a load of 4.9 kPa so as to evaluate the fixability in terms of a fixing initiation temperature ($T_{F1}$ (° C.)) as a lowest temperature giving an image density lowering due to the rubbing of at most 10%. A lower value of the temperature ($T_{F1}$) represents a better fixability. The image density was measured as a reflection density by using a Macbeth densitometer (available from Macbeth Co.) with an SPI filter.

[Continuous Image Forming Test]

Magnetic toner 16 was subjected to a copying test on $10^5$ sheets by using a commercially available copying machine ("GP-605", available from Canon K.K.) in an environment of 32.5° C./80% RH. As a result, images showing a high image density (I.D.) and with little density (ID) fluctuation were obtained. Detailed results are shown in Table 3. The image density was measured with respect to 5 images of each in 5 mm-circle on a sheet formed at the time of image formation on $10^5$ sheets as an average of 5 values measured as reflection densities by using a Macbeth reflection densitometer (available from Macbeth Co.) together with an SPI filter. The image density fluctuation was evaluated with respect to a solid black image formed after image formation on $10^5$ sheets and measuring an image density difference between a highest density part and a lowest density part on the sheet. If the toner movement in the developing device is inferior or the toner replenishment through the toner hopper is not smooth, a density fluctuation and fog are liable to occur. The evaluation was performed according to the following standard based on the maximum density difference on the same sheet.

| | | |
|---|---|---|
| A: | Density difference | <0.05 |
| B: | " | = 0.05 to below 0.10 |
| C: | " | = 0.10 to below 0.15 |
| D: | " | ≧0.15 |

Fog was evaluated by using a reflection densitometer ("REFLECT METER MODEL TC-6DS", available from Tokyo Denshoku K.K.). A highest reflection density at a white background portion on a transfer sheet after image formation was denoted by Ds, and an average reflection density of the transfer sheet before image formation was denoted by Dr to calculate Ds−Dr as a fog value. Based on the highest fog value during the continuous image formation, the fog level was evaluated according to the following standard.

A: Ds−Dr<0.5

B: Ds−Dr=0.5 to <1.0

D: Ds−Dr=1.0 to <1.5

D: Ds−Dr≧1.5

During the continuous printing test, the resultant images were evaluated with respect to image defects attributable to cleaning failure and melt-sticking on the photosensitive drum due to cleaning trouble liable to be caused by bridging, attachment onto the vessel or parts, caking or melt-sticking of the waste toner. The evaluation was performed according to the following standard.

A: No image abnormality.

B: Cleaning failure and melt-sticking occurred at non-image parts, but the images were not affected.

C: Cleaning failure and melt-sticking occurred at a low frequency but disappeared.

D: Cleaning failure and melt-sticking occurred and failed to disappear in same cases.

[Anti-blocking Test]

20 g of a toner sample was placed in a plastic cup and held in a thermostat vessel at 50° C. for 5 days. Thereafter, the toner state was observed with eyes and evaluated according to the following standard.

A: No agglomerate observed, and the toner flowing smoothly.

B: Some agglomerates observed but instantaneously disintegrated.

C: Agglomerates observed but easily collapsed.

D: Caking observed and did not easily collapse.

Example 12

| | |
|---|---|
| Binder resin 2 | 100 wt.parts |
| Magnetite (Dav. = 0.2 $\mu$m) | 90 " |
| Triphenylmethane lake compound | 2 " |
| Wax 2 | 5 " |
| Fischer-Tropshe wax (Tmax.abs. = 92.5° C.) | 2 " |

A positively chargeable Magnetic toner 17 (D4=6.8 $\mu$m) was prepared and evaluated in the same manner as in Example 11 except for using the above ingredients.

Example 13

| | |
|---|---|
| Binder resin 2 | 100 wt.parts |
| Magnetite (Dav. = 0.2 μm) | 90 " |
| Triphenylmethane lake compound | 2 " |
| Wax 3 | 5 " |
| Polypropylene wax (Tmax.abs. = 135.5° C.) | 2 " |

A positively chargeable Magnetic toner 18 (D4=6.7 μm) was prepared and evaluated in the same manner as in Example 11 except for using the above ingredients.

Example 14

| | |
|---|---|
| Binder resin 2 | 100 wt.parts |
| Magnetite (Dav. = 0.2 μm) | 90 " |
| Triphenylmethane lake compound | 2 " |
| Wax 6 | 5 " |
| Polypropylene wax (Tmax.abs. = 137.8° C.) | 2 " |

A positively chargeable Magnetic toner 19 (D4=6.5 μm) was prepared and evaluated in the same manner as in Example 11 except for using the above ingredients.

Example 15

| | |
|---|---|
| Binder resin 2 | 100 wt.parts |
| Magnetite (Dav. = 0.2 μm) | 90 " |
| Triphenylmethane lake compound | 2 " |
| Wax 7 | 5 " |
| Polyethylene wax (Tmax.abs. = 102.4° C.) | 2 " |

A positively chargeable Magnetic toner 20 (D4=6.6 μm) was prepared and evaluated in the same manner as in Example 11 except for using the above ingredients.

Example 16

| | |
|---|---|
| Binder resin 2 | 100 wt.parts |
| Magnetite (Dav. = 0.2 μm) | 90 " |
| Triphenylmethane lake compound | 2 " |
| Wax 8 | 5 " |
| Polyethylene wax (Tmax.abs. = 112.6° C.) | 2 " |

A positively chargeable Magnetic toner 21 (D4=6.4 μm) was prepared and evaluated in the same manner as in Example 11 except for using the above ingredients.

Example 17

| | |
|---|---|
| Binder resin 2 | 100 wt. parts |
| Magnetite (Dav. = 0.2 μm) | 90 wt. parts |
| Triphenylmethane lake compound | 2 wt. parts |

-continued

| | |
|---|---|
| Wax 10 | 5 wt. parts |
| Polyethylene wax (Tmax. abs. = 125.8° C.) | 2 wt. parts |

A positively chargeable Magnetic toner 22 (D4=6.4 μm) was prepared and evaluated in the same manner as in Example 11 except for using the above ingredients.

Example 18

| | |
|---|---|
| Binder resin 2 | 100 wt. parts |
| Magnetite (Dav. = 0.2 μm) | 90 wt. parts |
| Triphenylmethane lake compound | 2 wt. parts |
| Wax 13 | 5 wt. parts |
| Styrene-modified polypropylene wax (Tmax. abs. = 132.7° C.) | 2 wt. parts |

A positively chargeable Magnetic toner 23 (D4=5.7 μm) was prepared and evaluated in the same manner as in Example 11 except for using the above ingredients.

Example 19

| | |
|---|---|
| Binder resin 2 | 100 wt. parts |
| Magnetite (Dav. = 0.2 μm) | 90 wt. parts |
| Triphenylmethane lake compound | 2 wt. parts |
| Wax 14 | 5 wt. parts |
| Fischer-Tropshe wax (Tmax. abs. = 105.4° C.) | 2 wt. parts |

A positively chargeable Magnetic toner 24 (D4=5.8 μm) was prepared and evaluated in the same manner as in Example 11 except for using the above ingredients.

Example 20

| | |
|---|---|
| Binder resin 2 | 100 wt. parts |
| Magnetite (Dav. = 0.2 μm) | 90 wt. parts |
| Triphenylmethane lake compound | 2 wt. parts |
| Wax 5 | 5 wt. parts |
| Alcohol wax (Tmax. abs. = 102.3° C.) | 2 wt. parts |

A positively chargeable Magnetic toner 25 (D4=5.7 μm) was prepared and evaluated in the same manner as in Example 11 except for using the above ingredients.

The results of the above Examples 11–20 are inclusively shown in Table 3 below.

TABLE 2

Evaluation Results

| Ex. or Comp. Ex. | Toner | Wax | D4 (μm) | Fixability (° C.) | Image density | Density fluctuation | Image defects | Sleeve sticking | Anti-blocking |
|---|---|---|---|---|---|---|---|---|---|
| Ex. 1 | 1 | 1 | 6.8 | 145 | 1.36 | A | A | A | A |
| Ex. 2 | 2 | 2 | 6.6 | 145 | 1.33 | B | A | A | A |
| Ex. 3 | 3 | 3 | 6.7 | 145 | 1.34 | B | B | B | A |
| Ex. 4 | 4 | 6 | 6.5 | 150 | 1.35 | B | B | B | A |
| Ex. 5 | 5 | 7 | 6.2 | 150 | 1.37 | A | A | A | A |
| Ex. 6 | 6 | 8 | 6.4 | 150 | 1.34 | B | B | A | A |
| Ex. 7 | 7 | 10 | 6.6 | 155 | 1.32 | B | B | A | A |
| Ex. 8 | 8 | 13 | 5.8 | 145 | 1.38 | A | A | A | A |
| Ex. 9 | 9 | 14 | 5.7 | 150 | 1.39 | A | A | A | A |
| Ex. 10 | 10 | 15 | 5.9 | 150 | 1.37 | A | A | A | A |
| Comp. Ex. 1 | 11 | 4 | 6.5 | 145 | 1.35 | B | B | C | B |
| Comp. Ex. 2 | 12 | 5 | 6.6 | 140 | 1.27 | D | D | C | C |
| Comp. Ex. 3 | 13 | 9 | 6.4 | 160 | 1.33 | C | B | C | B |
| Comp. Ex. 4 | 14 | 11 | 6.7 | 150 | 1.26 | C | C | D | D |
| Comp. Ex. 5 | 15 | 12 | 6.7 | 165 | 1.34 | B | A | A | A |

TABLE 3

Evaluation Results

| Example | Toner | Wax | D4 (μm) | Fixability (° C.) | Image density | Density fluctuation | Fog | Image defects | Anti-blocking |
|---|---|---|---|---|---|---|---|---|---|
| Ex. 11 | 16 | 1 | 6.5 | 150 | 1.38 | A | A | A | A |
| Ex. 12 | 17 | 2 | 6.8 | 150 | 1.35 | A | B | A | A |
| Ex. 13 | 18 | 3 | 6.7 | 150 | 1.33 | B | B | B | A |
| Ex. 14 | 19 | 6 | 6.5 | 150 | 1.34 | B | B | B | A |
| Ex. 15 | 20 | 7 | 6.6 | 150 | 1.36 | A | B | A | A |
| Ex. 16 | 21 | 8 | 6.4 | 150 | 1.32 | B | B | A | A |
| Ex. 17 | 22 | 10 | 6.4 | 155 | 1.34 | B | B | B | B |
| Ex. 18 | 23 | 13 | 5.7 | 150 | 1.36 | A | B | A | A |
| Ex. 19 | 24 | 14 | 5.8 | 150 | 1.38 | A | A | A | A |
| Ex. 20 | 25 | 15 | 5.7 | 150 | 1.37 | A | B | A | A |

What is claimed is:

1. A toner, comprising a resinous composition including a binder resin and a wax (A), wherein the wax (A) contains at least 92 wt. % thereof of n (normal)-paraffin comprising a plurality of n-paraffin species having different numbers of carbon atoms, and provides a DSC (differential scanning calorimetry)-heat-absorption curve exhibiting a maximum heat-absorption peak showing a peaktop temperature of 70–90° C. and a half-value width of at most 12° C.

2. A toner according to claim 1, wherein the DSC-heat-absorption curve of the wax (A) exhibits an initial onset temperature of at least 50° C. and a terminal onset temperature of at most 100° C.

3. A toner according to claim 1, wherein the DSC-heat-absorption curve of the wax (A) exhibits an initial onset temperature of at least 55° C. and a terminal onset temperature of at most 95° C.

4. A toner according to claim 1, wherein the DSC-heat-absorption curve of the wax (A) exhibits an initial onset temperature of at least 60° C. and a terminal onset temperature of at most 90° C.

5. A toner according to claim 1, wherein the DSC-heat-absorption curve exhibits a maximum heat-absorption peak showing a peaktop temperature of 75–90° C.

6. A toner according to claim 1, wherein the DSC-heat-absorption curve exhibits a maximum heat-absorption peak showing a peaktop temperature of 75–85° C.

7. A toner according to claim 1, wherein the wax (A) contains at least 93 wt. % thereof of n-paraffin.

8. A toner according to claim 1, wherein the wax (A) contains at least 94 wt. % thereof of n-paraffin.

9. A toner according to claim 1, wherein the DSC-heat-absorption curve of the wax (A) exhibits a maximum heat-absorption peak showing a half-value width of at most 10° C.

10. A toner according to claim 1, wherein the DSC-heat-absorption curve of the wax (A) exhibits a maximum heat-absorption peak showing a half-value width of at most 8° C.

11. A toner according to claim 1, wherein the wax (A) comprises paraffin wax or Fischer-Trapshe wax.

12. A toner according to claim 1, wherein the wax (A) comprises n-paraffins exhibiting an average number of carbon atoms of 30–55.

13. A toner according to claim 1, wherein the wax (A) comprises n-paraffins showing a carbon atom number distribution giving a standard deviation S of 0.5–10.

14. A toner according to claim 1, wherein the wax (A) shows a kinematic viscosity at 100° C. of at most 20 $mm^2$/sec.

15. A toner according to claim 1, wherein the wax (A) shows a penetration at 25° C. of at most 10.

16. A toner according to claim 1, wherein the resinous composition further contains a wax (B) providing a DSC-heat-absorption curve exhibiting a maximum heat-absorption peak showing a peaktop temperature exceeding 90° C. and not exceeding 150° C.

* * * * *

UNITED STATES PATENT AND TRADEMARK OFFICE

CERTIFICATE OF CORRECTION

PATENT NO. : 6,203,959 B1
DATED : March 20, 2001
INVENTOR(S) : Hirohide Tanikawa et al.

It is certified that error appears in the above-identified patent and that said Letters Patent is hereby corrected as shown below:

Title page,
Item [56], References Cited, FOREIGN PATENT DOCUMENTS, "52-3305 1/1997 (JP):" should read -- 52-3305 1/1977 (JP): --.

Column 1,
Line 55, "supply" should read -- supplying --.

Column 3,
Line 39, "structures" should read -- structures, --.

Column 5,
Line 8, "Fischer-Tropshe" should read -- Fischer-Tropsch --; and
Line 48, "step" should read -- steps --.

Column 6,
Line 56, "heated at a rate of 40°C./min. to 160°" should be deleted; and
Line 57, "C.," should be deleted.

Column 7,
Line 34, "are" should read -- and --.

Column 8,
Line 38, "chmarone-" should read -- cumarone --.

Column 9,
Line 50, "constitute" should read -- constitutes --.

Column 10,
Line 15, "t-butylcumul" should read -- t-butylcumyl -- and "dicumul" should read -- dicumyl --.

Column 11,
Line 59, "constitutes" should read -- constitute --.

Column 13,
Line 12, "homologous," should read -- homologues --;
Line 21, "quainidine" should read -- guanidine --;
Line 39, "denotes" (second occurrence) should read -- denote --; and
Line 41, "be" should be deleted.

UNITED STATES PATENT AND TRADEMARK OFFICE

CERTIFICATE OF CORRECTION

PATENT NO. : 6,203,959 B1
DATED : March 20, 2001
INVENTOR(S) : Hirohide Tanikawa et al.

It is certified that error appears in the above-identified patent and that said Letters Patent is hereby corrected as shown below:

Column 16,
Line 48, "haolin;:" should read -- kaolin; -- and "phosphate" (second occurrence) should be deleted; and
Line 49, "compounds, such as apatite;" should be deleted.

Column 19,
Line 9, "dissolve" should read -- dissolved --;
Line 30, "was" (second occurrence) should read -- wax --; and
Table 1, "n-parrafin" should read -- n-paraffin --.

Column 20,
Line 3, "acrylate/divinylbenzene" should read -- acrylate/divinyl-benzine --.

Column 21,
Line 9, "are" should read -- and --.

Column 24,
Line 24, "DL" should read -- C: --;
Line 40, "same" should read -- some --.

Column 27,
Table 3, "150" should read -- 155 --; and "155" should read -- 155 --.

Column 28,
Line 47, "Fischer-Trapshe" should read -- Fischer-Tropsch --.

Signed and Sealed this

First Day of January, 2002

*Attest:*

*Attesting Officer*

JAMES E. ROGAN
*Director of the United States Patent and Trademark Office*